US006189753B1

(12) United States Patent
Kalhok et al.

(10) Patent No.: US 6,189,753 B1
(45) Date of Patent: Feb. 20, 2001

(54) CARRIER RACK FOR USE ON A WATERCRAFT

(75) Inventors: David Kalhok, Georgeville; Pierre Rondeau, Bromont, both of (CA)

(73) Assignee: Bombardier, Inc., Quebec (CA)

( * ) Notice: Under 35 U.S.C. 154(b), the term of this patent shall be extended for 0 days.

(21) Appl. No.: 09/204,690

(22) Filed: Dec. 3, 1998

(51) Int. Cl.[7] ..... B60R 9/00

(52) U.S. Cl. ..... 224/406; 114/343; 114/364; 224/401

(58) Field of Search ..... 224/406, 401, 224/547, 546, 568, 571, 917.5, 324; 114/343, 364; 211/60.1, 70.8; 248/201, 316.1, 499, 305

(56) References Cited

U.S. PATENT DOCUMENTS

| | | | | |
|---|---|---|---|---|
| D. 234,256 | | 2/1975 | Parsons | D12/157 |
| D. 235,759 | | 7/1975 | Parsons | D12/157 |
| D. 267,083 | | 11/1982 | Bomifield | D12/318 |
| D. 282,060 | | 1/1986 | DiAntioni | D2/157 |
| D. 300,914 | | 5/1989 | Arvidsson | D2/157 |
| D. 302,000 | | 7/1989 | Arvidsson | D12/157 |
| D. 302,262 | | 7/1989 | Dickerman | D12/157 |
| D. 332,594 | | 1/1993 | Dallaire et al. | D12/157 |
| D. 335,479 | | 5/1993 | Yamamoto | D12/157 |
| D. 340,020 | | 10/1993 | Yamamoto | D12/157 |
| D. 340,021 | | 10/1993 | Yamamoto | D12/157 |
| D. 348,034 | | 6/1994 | Mann | D12/412 |
| D. 350,109 | | 8/1994 | Ruffolo, Jr. | D12/406 |
| 3,018,897 | | 1/1962 | Carlyle | 211/60 |
| 3,155,238 | | 11/1964 | Bennett | 211/60 |
| 3,527,354 | | 9/1970 | Sokolow | 211/60 |
| 3,712,522 | | 1/1973 | Penniman | 224/29 R |
| 3,731,817 | * | 5/1973 | Fowlkes et al. | 211/70.8 |
| 3,776,437 | | 12/1973 | Carney | 244/42.45 R |
| 3,792,805 | | 2/1974 | Binding et al. | 224/29 R |
| 3,836,058 | | 9/1974 | Penniman et al. | 224/41.1 |
| 3,904,092 | | 9/1975 | Piper | 224/29 R |
| 4,048,700 | | 9/1977 | Browne | 280/11.37 |
| 4,056,220 | | 11/1977 | Trimble | 224/42.45 R |
| 4,132,381 | * | 1/1979 | McClellan | 248/316.1 |
| 4,232,806 | | 11/1980 | Shaid | 224/42.44 |
| 4,234,112 | | 11/1980 | Gallant | 224/42.43 |
| 4,271,997 | | 6/1981 | Michael | 224/42.45 R |
| 4,326,655 | * | 4/1982 | Gradek et al. | 224/324 |
| 4,330,065 | | 5/1982 | Haddad | 211/60 SK |
| 4,382,588 | | 5/1983 | Vovk et al. | 269/43 |
| 4,856,811 | | 8/1989 | Bressler et al. | 280/652 |
| 4,858,802 | | 8/1989 | Hamby et al. | 224/273 |
| 4,863,082 | | 9/1989 | Evans et al. | 224/42.45 R |
| 4,895,096 | | 1/1990 | Goodwin et al. | 114/381 |
| 4,907,525 | | 3/1990 | Schmidt | 114/364 |
| 4,991,807 | | 2/1991 | Radnich | 248/206.3 |
| 5,054,673 | | 10/1991 | Dixon | 224/324 |
| 5,078,279 | | 1/1992 | Hancock et al. | 211/64 |
| 5,105,754 | | 4/1992 | Collins | 114/343 |
| 5,145,135 | | 9/1992 | Thompson | 248/201 |
| 5,316,192 | | 5/1994 | Ng | 224/324 |
| 5,388,738 | | 2/1995 | Russell | 224/42.45 R |
| 5,605,321 | | 2/1997 | Jarvis | 269/100 |
| 5,906,304 | * | 5/1999 | Baldacchino | 224/406 |

FOREIGN PATENT DOCUMENTS

82/01357 4/1982 (WO) .

* cited by examiner

*Primary Examiner*—Stephen K. Cronin
*Assistant Examiner*—Maerena W. Brevard
(74) *Attorney, Agent, or Firm*—Pillsbury Winthrop LLP

(57) ABSTRACT

A carrier rack for use primarily on a watercraft. The carrier rack has a preferably two resilient, elastomeric cradles adapted to receive an object to be carried. The cradles are adapted to be mounted on an outside surface of the watercraft, most preferably the gunwales. A plurality of attachment straps are used to mount the carrier rack to the watercraft. An adjustable cradle-strap wraps around the cradle and causes the elastomeric cradle to conform partially to the shape of the object to be carried.

23 Claims, 3 Drawing Sheets

CARRIER RACK FOR USE ON A WATERCRAFT

FIELD OF THE INVENTION

The invention relates to devices for carrying and transporting objects on a watercraft or a similar vehicle, and more particularly, to a carrier rack for use on a watercraft or a similar vehicle.

BACKGROUND OF THE INVENTION

From the very beginning of boat design and construction, designers have devised innumerable ways of stowing and restraining on-board equipment and accessories. With the growing popularity of high-performance watercraft, the need to stow and restrain watersports' accessories, such as boards and waterskis, has become particularly relevant. Specifically, the design of racks and storage compartments that do not interfere with the operation of the watercraft permit these high-performance watercraft to be used and enjoyed in conjunction with other watersports such as waterskiing or boarding.

There are numerous examples in the prior art of racks for storing and transporting objects such as boards or waterskis. Some of the more salient examples are discussed briefly below.

U.S. Pat. No. 3,701,436 (Adams) discloses a water ski rack comprising two units for supporting a pair of water skis. Each unit comprises a fork-like rack element having three tines adapted to receive the skis therebetween, each rack element has a projecting part having transverse grooves. This projecting part is adapted to be inserted in an aperture of a bracket mounted on a suitable supporting structure. A spring adapted to cooperate with the groove is provided on each bracket in order to maintain the rack element in a determined position. A strap is provided to secure the skis in the rack elements.

U.S. Pat. No. 4,582,015 (Hunter) discloses a ski rack which comprises at least two sockets having at one end a projection forming a clamp. This clamp permits the attachment of the sockets preferably inside the boat, beneath the gunwale on one side. Two support members are adjustably secured within the sockets and extend upwardly, then horizontally across the top of the gunwale, and thereafter downwardly at an incline outside of the hull of the boat. Pairs of fingers are adjustably attached to the downwardly-sloping part of the support member (the arm), the fingers extend vertically and are sufficiently spaced apart from one another on each arm to receive a water ski and hold it securely during operation of the boat.

U.S. Pat. No. 5,390,837 (Ruffolo, Jr.) discloses a carrier, which comprises a base unit having a suction cup for securing the base unit to the exterior surface of the window. A bracket is secured to the base unit and has two ends. One is secured to the base unit and the other forms an U-shaped hanger engaging the top of the window. A support arm has a hooked end and a securing strap. This support arm is secured to the bracket at one end and extends away from the window at a substantial angle above the horizontal. The securing strap has a first end secured adjacent to the base unit and a second end having an aperture through which the hooked end is inserted. With a snowboard in place on the support arm, the securing strap is stretched over the board and attached to the hook such that the board is held in place between the securing strap and the support arm.

U.S. Pat. No. 4,330,065 (Haddad) discloses a portable water ski rack featuring in essence a pair of slotted A-frames. The skis fit into the parallel slots and are retained by an elastic retainer strap. This portable water ski rack is not designed to attach to the gunwales of a boat, nor does it have a substantially deformable cradle capable of embracing the objects to be carried.

U.S. Pat. No. 5,105,754 (Collins) discloses a boat ski rack apparatus mounted to the front and rear end walls of the engine compartment. The rack members have support legs connected to the engine compartment. A plurality of individual mounts slidably and frictionally engage within the support plates of the rack. The skis are strapped to the mounts. This arrangement, however, cannot be used on the gunwales of the watercraft nor does the rack have a deformable cradle capable of conforming itself to the shape of the object to be carried.

U.S. Pat. No. 4,863,082 (Evans et al.) discloses a water ski rack comprising a lower framed panel with slots therein and pivotally connected to the lower frame is a hinged upper framed panel that locks down and retains the skis. The ski slots are lined with a protective material and the slots in the upper framed panel are fronted with an elastic retainer band. When the upper framed panel is locked down with the skis inside the slots, the elastic retainer band expands into the upper slots, preventing the skis from rattling. This rack, however, cannot accommodate paddle boards or objects that are larger than skis.

U.S. Pat. No. 4,858,802 (Hamby et al.) discloses a water ski storage rack for boats comprising a generally upwardly v-shaped support and a base for mounting the v-shaped support to the boat outside the cockpit. The assembly is resiliently deformable in response to applied pressure. The skis rest on the v-shaped support. Although one prong of the v-shaped support is deformable, it is only linearly deformable and thus the angle between the prongs of the v-shaped support is fixed. In other words, the v-shaped support does not deform to conform to the shape of the object to be carried. Furthermore, this rack is only designed for carrying skis.

U.S. Pat. No. 4,232,806 discloses a water ski rack having a series of upwardly slanting ski-holding elements between which the skis can be set. The ski-holding elements are displaceable along the frame so that the gap between the ski-holding elements can be adjusted to accommodate skis of different sizes. However, there is no deformable cradle capable of conforming at least partially to the shape of the object to be carried. Furthermore, this rack is only designed for carrying skis.

U.S. Pat. No. 4,056,220 (Trimble) discloses a portable boat-carried rack for water skis and tow ropes comprising a pair of spaced apart A-shaped frame having slots therein. An elongated flexible strap restrains the skis within the slots. However, there is no deformable cradle capable of conforming at least partially to the shape of the object to be carried. Furthermore, this rack is only designed for carrying skis.

U.S. Pat. No. 4,234,112 (Gallant) discloses a water ski rack comprising a frame for securing skis in a substantially upright position. An elastic strap is further provided to restrain the skis in position. However, there is no deformable cradle capable of conforming at least partially to the shape of the object to be carried. Furthermore, this rack is only designed for carrying skis.

U.S. Pat. No. 5,078,279 (Hancock et al.) discloses a gun rack for supporting a rifle on a vertical wall of a truck or boat. The rack has a U-shaped holder and a hold-down member which can encircle an item that is being held in the holder. The device is specifically intended to be used on the interior surface of the vehicle (unlike the applicant's invention which is designed to be used on the exterior surface of a watercraft or similar vehicle.) Furthermore, the gun rack is meant to be permanently attached to the vertical wall.

Finally, PCT/FR81/00131 (Herbez) discloses a device for transporting a windsurf, a surf board or the like on a boat. The device has two U-shaped cradles capable of receiving a board. Along the top opening of the U-shaped cradle is a hingedly connected retaining member that locks the board into place. The cradle members are lined with a protective layer to prevent damage to the board.

One of the main issues faced by those designing personal watercraft is space consideration. Personal watercraft typically have very little extra space to work with due to their limited size and compact construction in comparison to conventional watercraft. In recent years, the developments in personal watercraft have enabled users to use these craft for short day trips and pulling waterskiers. As a result, there has been an increased need for storage space onboard these crafts. However, due to the space consideration problems faced by watercraft designers, there is always a desire in the art for an improved arrangement for onboard storage of articles without encroaching on the spaces necessary for the functional powered components of the vessel, such as the engine, steering controls, and propulsion system.

OBJECT AND STATEMENT OF THE INVENTION

To meet this need, the present invention provides a personal watercraft comprising a hull assembly; a steering control device carried by the hull assembly; a driver's seat adjacent the steering control device so as to enable a driver seated thereon to operate the steering control device; and an article carrier comprising a resiliently deformable cradle carried on an exterior surface of the hull. The cradle has surfaces defining an upwardly facing article receiving space configured to removably receive an article to be carried on the personal watercraft therein. The cradle is constructed and arranged so as to enable the article to be carried to be moved into the article receiving space such that the article engages the cradle so as to deform the cradle against the resiliency thereof to permit ingress of the article into the article receiving space and thereafter forceably engages the article to prevent relative movement of the article within the article receiving space thereof. For instance, the carrier rack can hold a board, waterskis or an oar. Due to the deformable resilience of the cradle, the carrier rack conforms somewhat to the shape of the object to be carried, thus preventing the object from rattling around in the cradle, coming loose or falling out. For a high-performance watercraft, it is particularly important to properly secure the object to be carried so that it does not rattle around in the cradle (and hence become damaged) when the watercraft takes sharp turns or bounces over waves. The use of such a carrier rack allows a watercraft to be used in conjunction with popular watersports such as knee- or boogie-boarding, waterskiing or surfing.

Preferably, the cradle is substantially elastomeric. An elastomeric, or rubbery, cradle minimizes vibration and "rattling around" of the object in the cradle that is both distracting and bothersome for the driver as well as potentially damaging to the object that is being carried, especially if the watercraft executes sharp turns and bounces roughly over waves. The use of an elastomer furthermore allows the cradle to conform to the different shapes of the objects that are to be carried. The elastomeric deformability allows curved and unusual shapes (e.g. surfboards, boogie boards, waterskis, oars, etc.) to be firmly secured in the cradle. Thus, the elastomeric cradle performs a double function: it conforms to the shape of the object to be carried and it absorbs shocks and attenuates vibrations. The overall effect is that objects of different sizes can be transported securely yet gently.

Preferably, the carrier rack comprises at least two spaced apart cradles. While the carrier rack can function with but a single cradle, it is advantageous to employ at least two cradles in order to properly restrain an elongated object like a pair of waterskis, a board or an oar. The distance between the cradles can be varied to best support an object of a given length.

Preferably, the cradle is made of a buoyant material. This is particularly advantageous when installing or removing the cradles over water. If the cradle falls in the water, it can be easily retrieved.

Preferably, the carrier rack further comprises at least two adjustable cradle-straps, each tensionable such that each said cradle conforms at least partially to the shape of said object. A simple cradle-strap allows the user to tighten the cradle around the object that is to be carried. By tightening the cradle-strap, the cradle conforms somewhat to the shape of the object to be carried.

Preferably, the cradle-strap is adapted to at least partially wrap around each said cradle to restrain said object. The cradle-strap wraps over the top-side opening of the cradle, thus restraining the object from the top, preventing the object from jumping out of the cradle.

Preferably, each cradle is detachably secured to said watercraft. It is particularly advantageous that the cradles can be removed and stowed when not in use.

Preferably, each cradle has a rear portion shaped to mate with the contours of a gunwale of the watercraft. By locating the carrier rack along the gunwale, the rack does not interfere substantially with the ordinary operation of the watercraft. The driver of the watercraft is unencumbered and can access all the parts of the watercraft that need to be accessed during normal operation.

Preferably, the carrier rack further comprises an anchor-strap having a first end affixed to said cradle and a portion of a second end passing through said aperture, said first end being adapted to provide adjustments to the length of said anchor-strap. This arrangement provides for easy installation and removal of the carrier rack from the watercraft.

Preferably, the carrier rack further comprises a hook affixed to said cradle and adapted to be mounted on an outside surface of the watercraft. Again, this arrangement makes the installation and removal of the rack simple and quick.

In a preferred embodiment of the present invention two identical carrier racks are mounted on the watercraft in order to support the object to be carried adjacent the respective ends thereof. One carrier has a cradle and a plurality of attachment means. An anchor base having an aperture is secured, by means of screws, to the inside surface of the watercraft's side rail. An anchor-strap is affixed at one end under the cradle. On a portion of the other end of this anchor-strap, an attachment can be moved in order to adjust the position of the cradle with respect to the side rail. This attachment has a projection adapted to be inserted in the aperture. A hook is also affixed under the cradle. The shape of this hook substantially matches the outside surface of the side rail. An adjustable cradle-strap which is mounted on the carrier is adapted to secure the object to be carried.

Other objects and features of the invention will become apparent by reference to the following description and to the drawings.

BRIEF DESCRIPTION OF THE DRAWINGS

A detailed description of the preferred embodiment of the invention is provided herein with reference to the following drawings, wherein.

Figure 1:
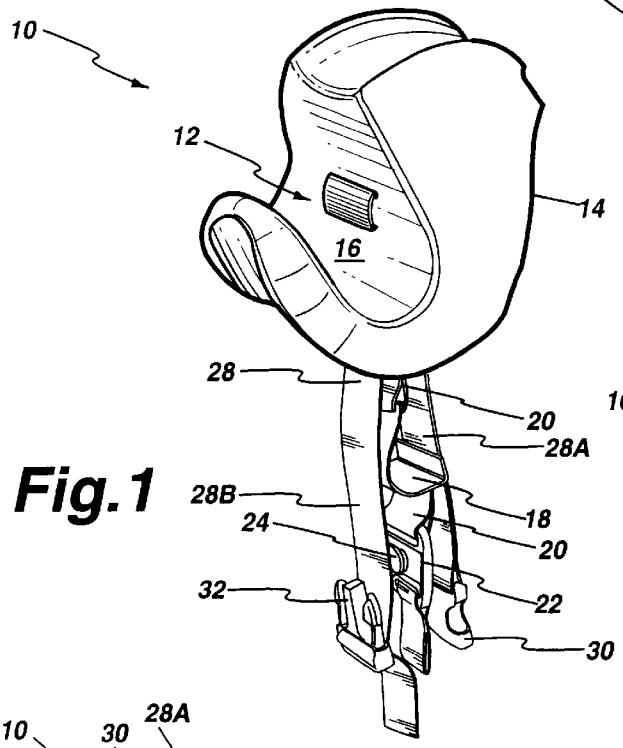
FIG. 1 is an isometric view of the carrier rack according to the present invention.

In the drawings, the preferred embodiment of the invention is illustrated by way of example. It is to be expressly understood that the description and drawings are only for the purpose of illustration and as an aid to understanding, and are not intended as a definition of the limits of the invention.

DESCRIPTION OF THE PREFERRED EMBODIMENTS

Figure 2:
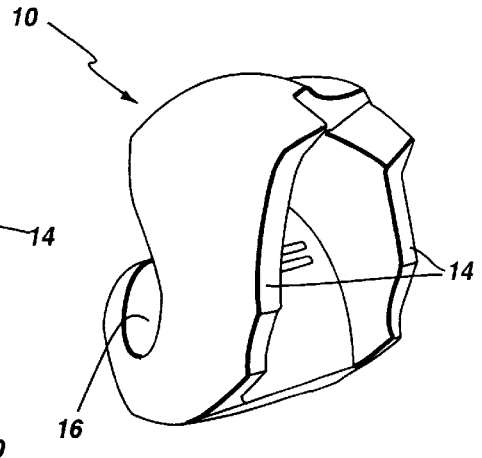
FIG. 2 is a rear isometric view of the carrier rack of FIG. 1.

As illustrated in FIGS. 1 and 2, a carrier rack (or, more generically, an article carrier) designated comprehensively by the reference numeral 10 comprises a cradle 12 having a substantially U-shaped region 16 for receiving an object to be carried by the carrier rack. The U-shaped region 16 (also referred to as an article receiving space) could equivalently have other profiles or shapes for accommodating specific objects. The cradle 12 of the carrier rack 10 is preferably made of a resilient material so as to embrace the object to be carried. Most preferably, the cradle 12 is made of an elastomeric material, i.e. a material that is a natural or synthetic rubbery or a material that is rubber-like. In the most preferred embodiment, the cradle 12 is made of neoprene. In this most preferred embodiment, the cradle 12 is buoyant so that if the carrier rack falls into the water during installation or removal, it will float and thus be easily retrievable.

Figure 5:
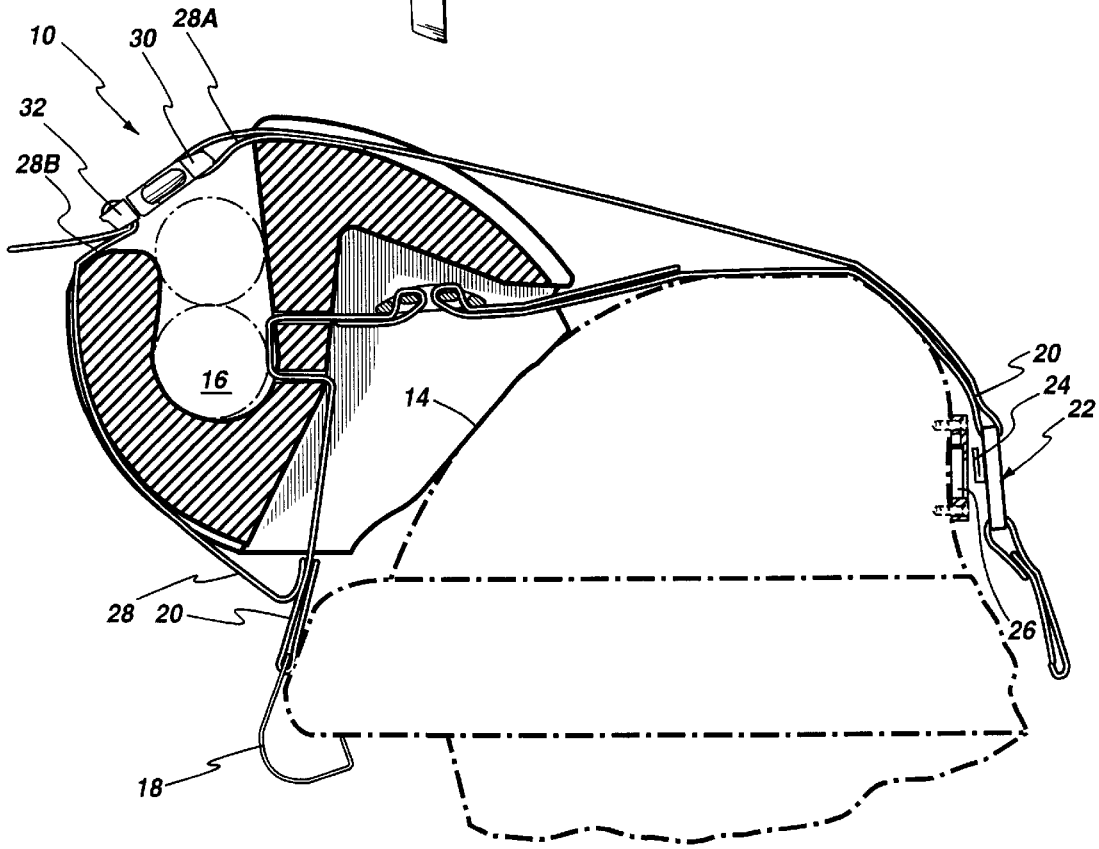
FIG. 5 is sectional view taken along section 5—5 of FIG. 4.
Figure 3:
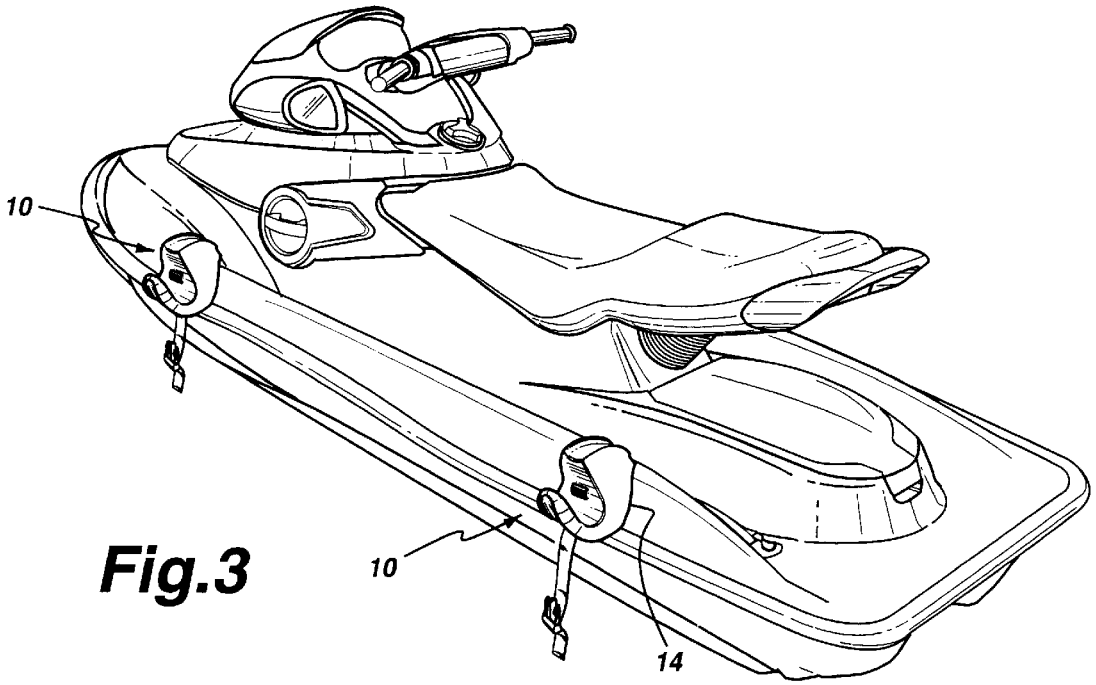
FIG. 3 is an isometric view of a carrier rack having two cradles mounted on the port gunwale of a personal watercraft.

As shown in FIGS. 2, 3 and 5, the carrier rack 10 also comprises a rear portion 14 that is shaped so as to fit against a gunwale of the watercraft. Since, in the most preferred embodiment, the cradle 12 is made of an elastomer, the cradle fits snugly against the gunwale of the watercraft without risk of incurring damage to the gunwale, which in the case of a personal watercraft, for instance, is made of fibreglass. Similarly, when bouncing over waves, the carrier rack will not create any impact damage to the gunwale since the elastomeric cradle 12 is substantially soft and pliant compared to the gunwale.

Figure 4:
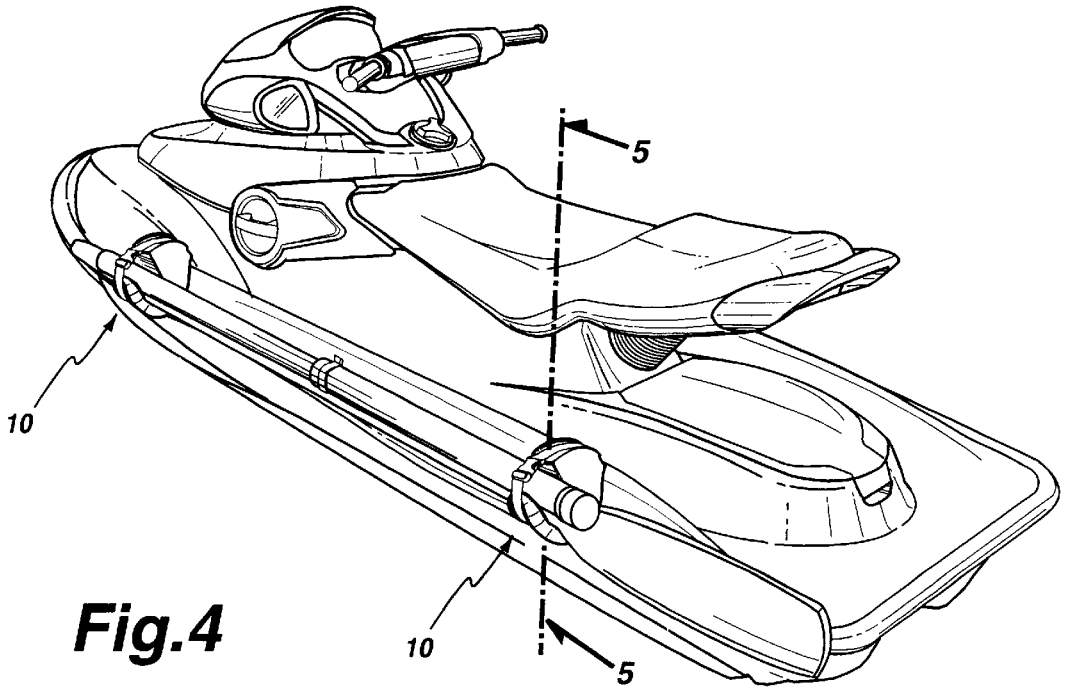
FIG. 4 is an isometric view of an oar being held by the carrier rack of FIG. 3.
Figure 6:
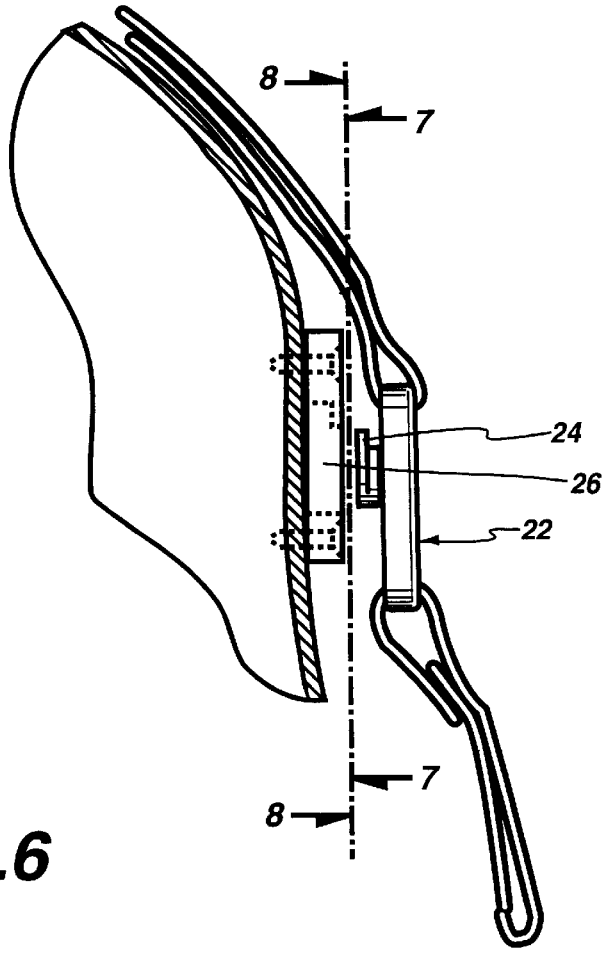
FIG. 6 is side elevational view of the attachment of the anchor-lever to the anchor-base which is fastened to the watercraft.
Figure 7:
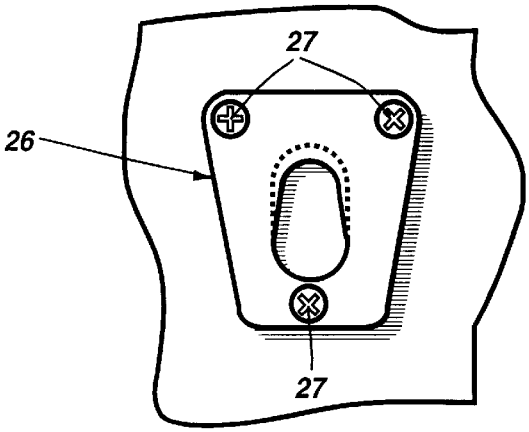
FIG. 7 is a sectional view taken along section 7—7 of FIG. 6, showing the anchor-base.
Figure 8:
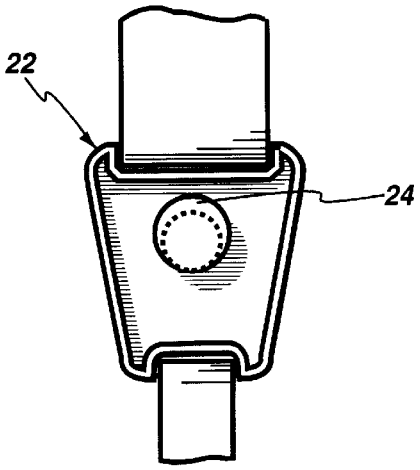
FIG. 8 is a sectional view taken along section 8—8 of FIG. 6, showing the anchor-lever.

In the most preferred embodiment, as illustrated in FIGS. 3 and 4, two carrier racks 10 are mounted on a watercraft in order to support an object to be carried (e.g. an oar or paddle board).

For purposes of this specification, it is understood that the word "watercraft" includes, but it is not confined to, personal watercraft, jet boats, or any other boat or similarly shaped vehicle upon which a carrier rack could be mounted. For instance, it may be possible to modify such a carrier rack to be used on a sailboat or yacht. It may even be possible to modify the carrier rack to be mountable to a land vehicle.

The present invention, however, is preferably directed to use with personal watercraft of the type depicted in FIGS. 3 and 4. A personal watercraft is a vehicle where the driver sits on a driver's straddle-type seat adjacent said steering control device so as to enable a driver seated thereon in straddle fashion to operate said steering control device.

It should also be understood that the expression "object to be carried" or article to be carried can be a watercraft accessory like an oar, waterski, surfboard, boogie board, knee-board or paddle board. The object to be carried could also be a rifle or any elongated object that would reasonably fit into the cradle.

It should also be understood that the carrier rack can be installed with only one cradle, with two cradles or with a plurality of cradles on either side or on both sides of the watercraft with departing from the spirit and scope of the invention. However, in the most preferred embodiment, as shown in FIGS. 3 and 4, the carrier rack uses two spaced apart cradles to best support an elongated object like an oar, for instance.

For each cradle 12 is an an elongated flexible retaining element in the form of adjustable cradle-strap 28, each cradle-strap being tensionable such that each said cradle conforms at least partially to the shape of the object to be carried. The cradle-strap can be wrapped around the object to be carried, as shown in FIGS. 4 and 5. By tightening the cradle-strap 28, the cradle 12, due to its resilient and elastomeric properties, conforms partly to the shape of the object that is being received in the cradle. Since the cradle is elastomeric, the object being carried is embraced tightly yet gently in such a manner as to prevent the object from rattling around, coming loose, or becoming damaged when the watercraft to which the carrier rack is mounted bounces over waves.

In the most preferred embodiment, the carrier rack 10 comprises a gunwale mounting structure in the form of a metal hook 18 having a pair of opposing leg portions, one of which is inboard, one of which is outboard. The hook, which may be made of stainless steel or a material that is non-corrosive in seawater, is affixed to the base 14. The hook 18 has a C-shape to enable its insertion in the protective band of the side rail of the watercraft. One end of an anchor-strap 20 is also affixed to the hook 18. The other end of the anchor-strap 20 has a portion on which a slidable anchor-lever 22 is mounted. This anchor-lever 22 is made of a light material such as plastic and has an extrusion 24 for engaging an anchor-base 26. The anchor-base 26 is secured, by means of screws 27, for example, to the inside surface of the side rail. Alternatively, the anchor-base 26 could be secured to the inside surface of the side rail by means of rivets, bolts, bonding, clips, clamps or any other mechanical fastener or attachment device. Furthermore, the attachment of the anchor-lever to the anchor-base need not necessarily be the slotted mechanism shown in the drawings, although that is the preferred way. The attachment of the anchor-lever to the anchor-base can be with a hook, a clip, a clamp, or any mechanical connector that is easily connected and disconnected and which anchors the anchor-lever in the anchor-base.

As illustrated in FIGS. 5–8, the anchor-lever 22 can be moved in order to adjust the position of the cradle 12 with respect to the side rail. Once the desired position is obtained, the hook 18 is mounted on the outside surface of the side rail, the anchor-lever 22 is secured to the anchor-base 26 and the carrier 10 is then mounted on the watercraft as illustrated in FIG. 3.

One end of a first portion 28A of an adjustable cradle-strap 28 is secured to the base 14 while the other end comprises a female fastener or latch member 30. One end of a second portion 28B is also secured to the base 14 while an adjustable male fastener 32 is slidably mounted on the other end. It should be noted that in the most preferred embodiment, the fasteners 30, 32 are a trident prong clip. However, the fastener for the cradle-strap could also be a buckle, hook and loop, Velcro™, clip, clamp or any such mechanical fastening device.

In operation, the object to be carried is positioned in the two cradles 12, and once properly positioned, the portion 28B is pulled and bent over the top surface of the object to be carried (the length of the portion 28B being adjustable with the male fastener 32), and the male fastener 32 is attached to the female fastener 30 while the adequate length of the cradle-strap 28 is obtained in order to secure the object to be carried in the cradles. When the object is in the cradle 12, the cradle-strap 28 is tightened so that the cradle embraces the object to be carried.

The above description of the preferred embodiment should not be interpreted in any limiting manner since variations and refinements are possible which are within the spirit and scope of the present invention. The scope of the invention is defined in the appended claims.

What is claimed is:

1. A watercraft comprising:

a hull assembly;

a steering control device carried by said hull assembly;

a driver's straddle-type seat adjacent said steering control device so as to enable a driver seated thereon in straddle fashion to operate said steering control device;

an article carrier comprising a resiliently deformable cradle carried on an exterior surface of said hull, said cradle having surfaces defining an upwardly facing article receiving space configured to removably receive an article to be carried on said watercraft therein;

said cradle being constructed and arranged so as to enable the article to be carried to be moved into said article receiving space such that the article engages said cradle so as to deform said cradle against the resiliency thereof to permit ingress of the article into said article receiving space and thereafter said cradle forceably engages the article to prevent relative movement of the article within said article receiving space thereof.

2. A watercraft according to claim 1, wherein said cradle is formed separately from said hull assembly and is thereafter fixedly mounted to said hull assembly.

3. A watercraft according to claim 1, wherein article carrier comprises a pair of said cradles each respectively mounted on exterior surfaces of said hull assembly in spaced apart relation to one another so as to enable an article to be received in the article receiving spaces of both of said cradles.

4. A watercraft according to claim 1, wherein said cradle is removably mounted to said hull.

5. A watercraft according to claim 4, wherein said cradle is buoyant so as to prevent sinking thereof in an event said cradle is removed from said watercraft in a body of water.

6. A watercraft according to claim 1, wherein said article receiving space is generally U-shaped.

7. A watercraft according to claim 1, wherein said cradle is mounted on an outboard port or starboard edge portion of said hull assembly at a position wherein a driver seated in straddle fashion on said driver's seat is able to manually grasp the article received within said article receiving space.

8. A watercraft according to claim 3, wherein each of said cradles are mounted on an outboard port or starboard edge portion of said hull assembly at positions wherein a driver seated in straddle fashion on said driver's seat is able to manually grasp the article received within said article receiving spaces.

9. A watercraft according to claim 1, further comprising a gunwale mounting structure, said cradle being mounted on said gunwale mounting structure and said gunwale mounting structure being mounted on a gunwale of said hull assembly of said watercraft.

10. A watercraft according to claim 9, wherein said gunwale mounting structure has a pair of opposing leg portions depending downwardly therefrom, said gunwale mounting structure being mounted to said gunwale with an outboard one of said leg portions engaging an outboard facing surface of said gunwale and an inboard one of said leg portions engaging an inboard facing surface of said gunwale.

11. A watercraft according to claim 10, wherein said hull assembly has an underside surface below said gunwale and wherein said gunwale mounting structure has a hook portion depending from outboard leg portion thereof and engaged underneath said gunwale with said underside surface.

12. A watercraft according to claim 11, further comprising a plurality of fasteners inserted through the inboard leg portion of said gunwale mounting structure and fixed to the inboard facing surfaces of said gunwale to secure said gunwale mounting structure.

13. A watercraft according to claim 12, wherein said fasteners are threaded screws.

14. A watercraft according to claim 1, wherein said article carrier further includes a releaseable connecting structure and a flexible retaining element, said retaining element and said connecting structure being constructed and arranged to enable said retaining element to be extended over an article received in said article receiving space of said cradle and releaseably secured in place by said connecting structure such that said retaining element cooperates with said cradle to retain the article in said article receiving space.

15. A watercraft according to claim 14, wherein said flexible retaining element comprises a pair of flexible retaining element portions and wherein said connecting structure comprises a pair of releasable interconnecting devices, each of said flexible connecting element portions having a free end with a respective one of said releaseable interconnecting devices attached thereto, said releaseable interconnecting devices being constructed and arranged to be interconnected together in a releasably interlocked relationship to releaseably secure said flexible retaining element in place.

16. A watercraft according to claim 15, wherein said one of said releasable interconnecting devices is a male latch member and the other of said releasable interconnecting devices is a female latch member.

17. A watercraft according to claim 14, further comprising a gunwale mounting structure, said cradle being mounted on said gunwale mounting structure and said gunwale mounting structure being mounted on a gunwale of said hull assembly of said watercraft.

18. A watercraft according to claim 17, wherein said flexible connecting element is fixed to said gunwale mounting structure.

19. A watercraft according to claim 18, wherein said flexible retaining element comprises a pair of flexible retaining element portions and wherein said connecting structure comprises a pair of releasable interconnecting devices, each of said flexible connecting element portions having a free end with a respective one of said releaseable interconnecting devices attached thereto and a fixed end fixed to said gunwale mounting structure, said releaseable interconnecting devices being constructed and arranged to be interconnected together in a releasably interlocked relationship to releaseably secure said flexible retaining element in place.

20. A watercraft according to claim 19, wherein said gunwale mounting structure has a pair of opposing leg portions depending downwardly therefrom, said gunwale mounting structure being mounted to said gunwale with an outboard one of said leg portions engaging an outboard facing surface of said gunwale and an inboard one of said leg portions engaging an inboard facing surface of said gunwale.

21. A watercraft according to claim 20, wherein said hull assembly has an underside surface below said gunwale and wherein said gunwale mounting structure has a hook portion depending from outboard leg portion thereof and engaged underneath said gunwale with said underside surface.

22. A watercraft according to claim 21, further comprising a plurality of fasteners inserted through the inboard leg portion of said gunwale mounting structure and fixed to the inboard facing surfaces of said gunwale to secure said gunwale mounting structure.

23. A watercraft according to claim 22, wherein said fasteners are threaded screws.

* * * * *